US006174492B1

(12) United States Patent
Castle et al.

(10) Patent No.: US 6,174,492 B1
(45) Date of Patent: Jan. 16, 2001

(54) FOREBAY FOR AM METALLURGICAL FURNACE

(75) Inventors: John F. Castle; Philip J. Gabb, both of Bristol (GB); David B. George, Salt Lake City, UT (US)

(73) Assignee: Kennecott Utah Copper Corporation, Magna, UT (US)

( * ) Notice: Under 35 U.S.C. 154(b), the term of this patent shall be extended for 0 days.

(21) Appl. No.: 09/241,142

(22) Filed: Feb. 1, 1999

Related U.S. Application Data

(60) Provisional application No. 60/074,516, filed on Feb. 12, 1998.

(51) Int. Cl.[7] ..... C21B 3/04
(52) U.S. Cl. ..... 266/229; 266/227; 266/275
(58) Field of Search ..... 266/227, 275, 266/229, 230, 232

(56) References Cited

U.S. PATENT DOCUMENTS

| | | | | |
|---|---|---|---|---|
| 2,577,764 | | 12/1951 | Hulme | 75/51 |
| 3,630,708 | | 12/1971 | Ihrig et al. | 65/168 |
| 4,097,032 | * | 6/1978 | Mauritz | 266/230 |
| 4,139,371 | | 2/1979 | Makipirtti et al. | 75/73 |
| 4,169,725 | | 10/1979 | Makipirtti | 75/74 |
| 4,362,561 | | 12/1982 | Weigel et al. | 75/92 |
| 4,415,356 | | 11/1983 | Victorovich et al. | 75/21 |
| 4,940,486 | | 7/1990 | Sommerville et al. | 75/10.19 |
| 5,312,525 | | 5/1994 | Pal et al. | 204/64 R |
| 5,314,524 | | 5/1994 | Pal et al. | 75/10.35 |
| 5,375,818 | * | 12/1994 | Laszlo | 266/230 |
| 5,380,353 | | 1/1995 | Goto et al. | 75/640 |
| 5,449,395 | | 9/1995 | George | 75/586 |
| 5,527,374 | | 6/1996 | Pal et al. | 75/10.46 |
| 5,700,308 | | 12/1997 | Pal et al. | 75/10.1 |
| 5,888,270 | | 3/1999 | Edwards et al. | 75/643 |

FOREIGN PATENT DOCUMENTS

| | | | |
|---|---|---|---|
| 169990 | 10/1921 | (GB) . | |
| 55-089415 | 7/1980 | (JP) | C21C/5/56 |
| 63-038507 | 2/1988 | (JP) | C21B/11/00 |

OTHER PUBLICATIONS

Torres, N., *CIM Bulletin*, vol. 77, No. 871, Nov. 1984, pp. 86–91.

* cited by examiner

*Primary Examiner*—Scott Kastler
(74) *Attorney, Agent, or Firm*—Whyte Hirschboeck Dudek SC

(57) ABSTRACT

A metallurgical furnace, preferably a metallurgical furnace for the production of copper, is equipped with a forebay. The forebay is in open communication with the settler of the furnace by a passageway that allows for the continuous removal of both slag and metal product, e.g. matte, blister copper, etc. The slag and metal product maintain their phase-separated relationship as they enter the forebay. The forebay is equipped with a weir that divides the forebay into a slag skimming chamber and a riser chamber. The slag skimming chamber has at least one slag overflow notch on at least one sidewall. The notch is located at an elevation on the sidewall such that only slag enters and is removed from the forebay. The notch is above the top surface of the metal product, i.e. it is above the interface between the slag and metal product layers. The weir is located downstream from the slag overflow notch, and it is positioned such that it acts as a dam to the slag but not the metal product, the latter of which underflows the weir and flows into the riser chamber. The molten metal product continuously overflows the end wall of the riser chamber through at least one metal product overflow notch into any means, e.g. a launder, tundish, etc. for transfer to another vessel (e.g. a holding furnace, an anode furnace, etc.).

13 Claims, 5 Drawing Sheets

FIG. 2D
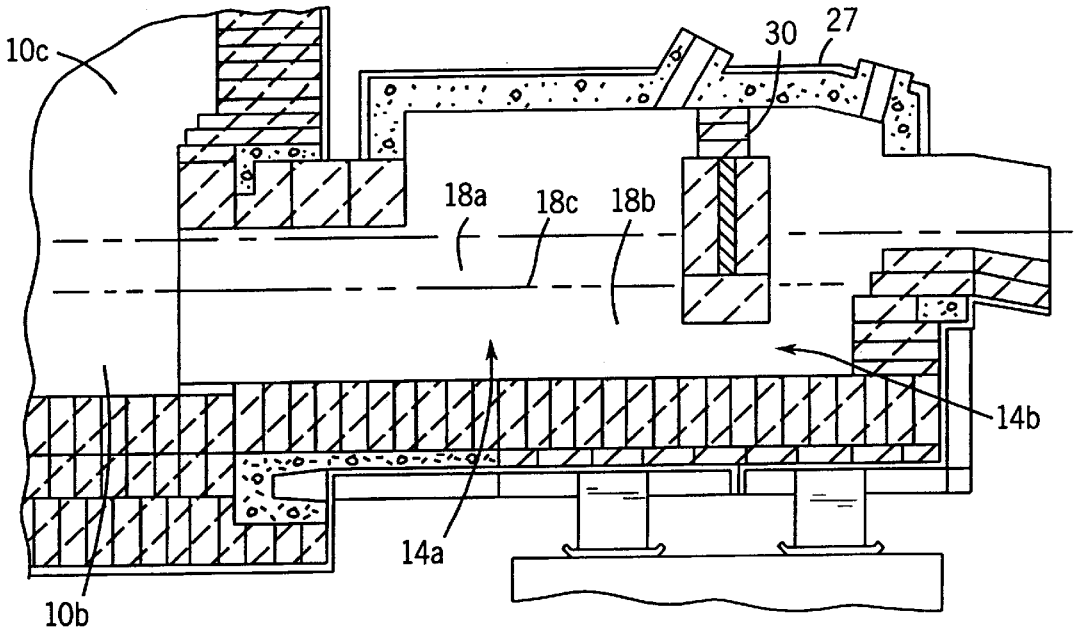
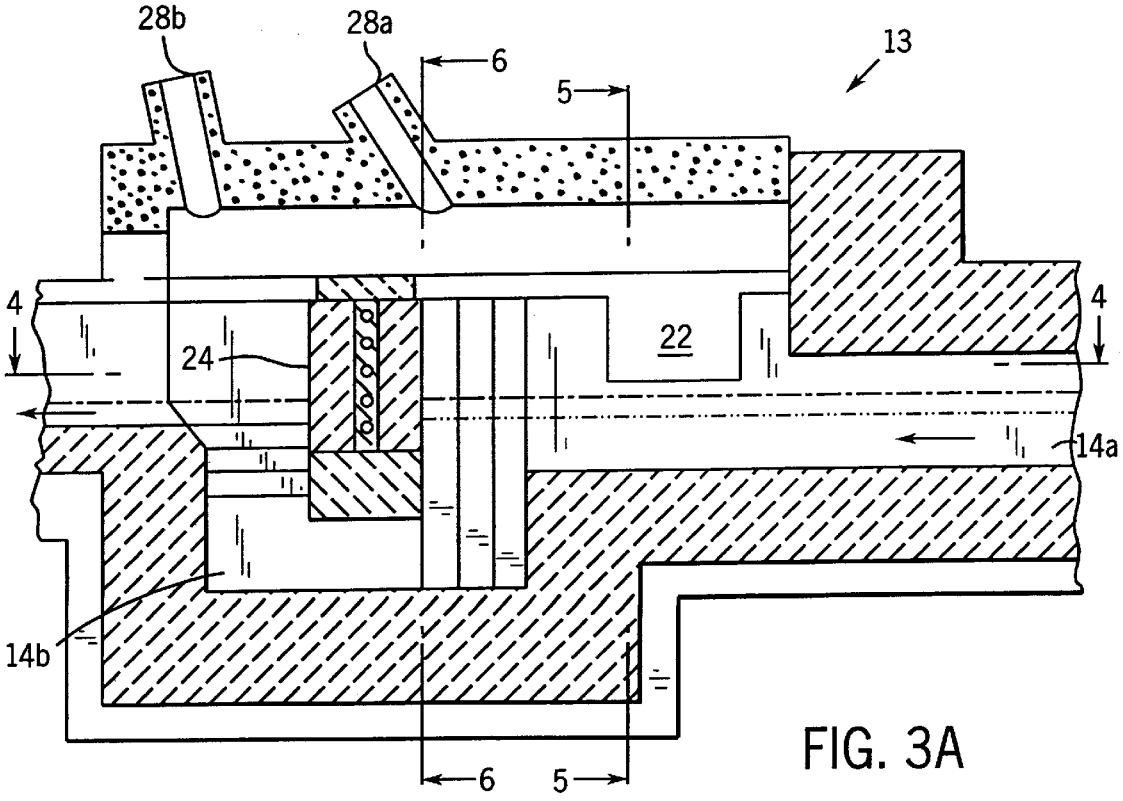
FIG. 3A

FOREBAY FOR AM METALLURGICAL FURNACE

This application claims benefit to provisional application 60/074,516 filing date Feb. 12, 1998.

BACKGROUND OF THE INVENTION

This invention relates to metallurgical furnaces. In one aspect, this invention relates to a forebay attached to a metallurgical furnace while in another aspect, this invention relates to a method of removing a melt from a metallurgical furnace through a forebay. In yet another aspect, this invention relates to using a forebay to physically separate molten slag from molten metal product.

Metallurgical melts (or simply melts) are the molten contents of a metallurgical furnace. The melts of a metallurgical furnace are typically removed or recovered through tapholes in the furnace walls. Melts, particularly the melts of quiescent bath furnaces, typically comprise two relatively immiscible layers, a slag layer and a metal product layer. The metal product layer contains the desired product, e.g. molten copper or nickel matte, molten blister copper, etc., and the slag layer contains the melt waste, e.g. gangue mineral, flux, iron oxides and the like (although in many situations, the slag layer contains a sufficient concentration of metal values that it is recycled or further processed before ultimate disposal). The slag typically has a low specific gravity relative to, and thus floats on top of, the molten metal product.

Various methods exist for separating a slag phase from a metal product phase. Lead and iron furnaces drain both metal product and slag phases through one tap hole into a vessel or containment which is separate and apart from the furnace and in which one phase is separated from the other. In lead metallurgy, this separation vessel is known as a forehearth. In iron metallurgy, this separation containment is known as a runner. In certain copper metallurgical processes, e.g. the Mitsubishi process, the melt of the smelting furnace is transferred by launder to a separation furnace in which the slag phase is separated from the molten matte (e.g. U.S. Pat. No. 5,380,353).

The usual method for removing a melt, at least in most copper and nickel metallurgical processes, is to remove the individual phases separately, and this is usually accomplished by draining the individual phases through tapholes located at different elevations on one or more of the furnace side walls. Slag is "skimmed" from the top of the molten metal product by draining it through tapholes located above the top surface of the molten metal product or, in other words, above the interface between the slag and the molten metal product. The molten metal product is drained from the furnace through tapholes located below the bottom surface of the slag layer or, in other words, below the interface of the slag and molten metal product. This system of using tapholes for removing slag and molten metal product from a metallurgical furnace is not without problems.

One problem is maintenance. The refractory about every taphole, particularly a slag taphole, is subject to accelerated wear relative to the wear experienced by the refractory in other areas of the furnace. Moreover, usually about every taphole and behind the refractory are water-cooled blocks (typically made of cast copper). The purpose of these blocks is to provide protection to and prolong the life of the furnace refractory located about the tapholes. Maintenance, e.g. repair or replacement, of both the internal refractory and the cooling blocks immediately behind the internal refractory can occur only when the furnace is out of operation (as opposed to the external refractory and those blocks behind it which can be serviced while the furnace is in operation) and since these internal refractory and cooling blocks require more frequent attention then do the others of the furnace, this means that the furnace must be taken out of operation more frequently than would otherwise be required if the furnace did not use functioning tapholes.

Another problem associated with tapholes relates to their sealing. When not in use, tapholes must be closed and this is accomplished typically with the injection of clay. When use of the taphole is required, the clay must be removed, typically with an oxylance or drilling apparatus. Both techniques are labor intensive and awkward.

Yet another problem associated with tapholes is the possibility of a "run away" discharge of the metallurgical melt, e.g. slag, molten matte, blister copper, etc. If the tap hole becomes enlarged or misshapened (either or both of which can result from poor execution of the tap hole opening procedure), then stopping the flow of melt from the furnace can be difficult and a run-away can result in which the receiving vessel or the laundering channels overflow. This, in turn, can cause significant damage to the metallurgical equipment and facility, and the clean-up of such a spill can be expensive.

Still another problem associated with tapholes is the "batch" nature in which they are used, e.g. first slag is removed from the top of the blister copper, then blister copper itself is removed in a separate operation. Continuing with the example of slag and blister copper, subsequently the volume of blister copper from the furnace is allowed to increase such that the slag level is raised to a level for another removal operation, and the cycle repeats. This constant fluctuation in the level of slag and blister copper in the settling zone of the furnace increases the wear on the refractory that is exposed to this repeated change in elevation. Moreover, the metallurgy of the operation can also be affected by variation in the melt volumes.

SUMMARY OF THE INVENTION

According to this invention, a metallurgical furnace, preferably a metallurgical furnace for the production of copper, is equipped with a forebay which is in open communication with the settler of the furnace. Slag and metal product, e.g. matte, blister copper, etc., move continuously from the settler of the furnace into the forebay in which the slag and metal product are separated from one another. The slag and metal product maintain their phase-separated relationship as they enter the forebay.

The forebay comprises a slag skimming chamber or zone equipped with a weir on one end and at least one tapping or overflow notch on at least one sidewall. This (these) notch (es) is (are) located at an elevation on the sidewall such that only slag enters and is removed from the forebay slag skimming chamber. The bottom of the notch(es) is(are) above the top surface of the metal product.

The weir of the forebay is located downstream from the slag overflow notch, and it is positioned (usually attached to both forebay side walls) such that it acts as a dam to the slag but not the metal product which underflows the weir to a point beyond the weir in the forebay referred to as the riser chamber or zone. The metal overflows this riser chamber through a metal overflow notch(es) on the end and/or side walls. In this manner, the molten metal product continuously overflows the end wall of the forebay into any means, e.g. a launder, tundish, etc. for transfer to another vessel (e.g. a holding furnace, an anode furnace, etc.).

The slag and metal removed from the forebay by way of the notches can be transported by any convenient means to any convenient destination, e.g. by a launder to a furnace for recycle or further processing, by launder or spout to a granulation apparatus, by launder or spout to a movable vessel, e.g a "pot", for solidification and disposal, etc.

BRIEF DESCRIPTION OF THE DRAWINGS

FIG. 2D is a side, cut-away cross-section of another embodiment of the furnace and forebay of FIG. 1.

FIG. 3A is a side, cut-away cross-section of the forebay of FIG. 2A along the line 3—3 of FIG. 1.

DESCRIPTION OF THE PREFERRED EMBODIMENTS

Various embodiments of the invention are described by reference to the drawings in which like numerals are employed to designate like parts. Although various items of equipment, such as fittings, mountings, pipes, and the like, have been omitted so as to simplify the description, such conventional equipment can be employed as desired. Moreover, although the following description is in the context of a flash furnace for converting solid copper matte to molten blister copper, this is but one embodiment of this invention and is provided here principally as a vehicle of illustration. Other embodiments are available, and include forebays in combination with smelting furnaces, holding furnaces, separation furnaces, and the like used in the production of copper and/or other metals, e.g. nickel, lead, etc.

Figure 1:
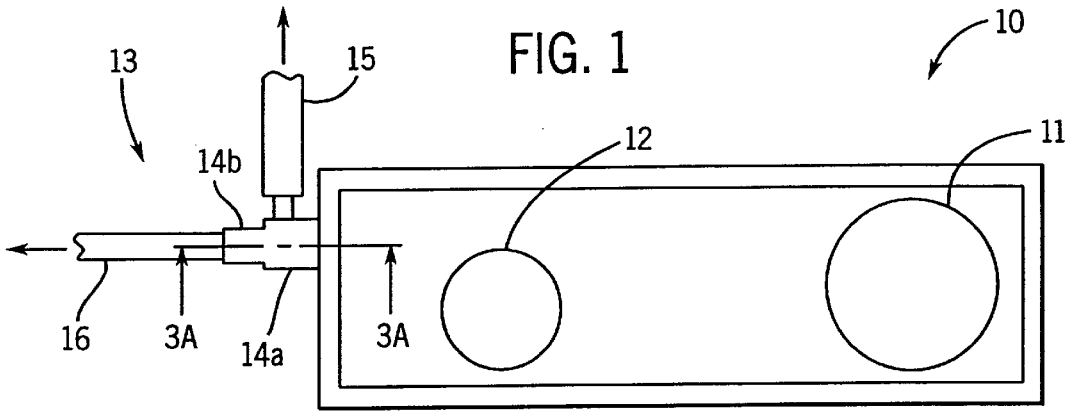
FIG. 1 is a top perspective of a flash furnace attached to which is a one embodiment of a forebay.

FIG. 1 shows a flash converting furnace 10 equipped with a reaction shaft 11 (in which solid copper matte is reacted with oxygen and flux) and an offtake (otherwise known as an uptake or riser) shaft 12 (for removal of exhaust gases). Representative flash converting furnaces include that used by Kennecott Utah Copper Corporation at its Magna, Utah facility. Flash converting furnaces are similar in construction and operation to flash smelting furnaces, and the latter are well described in the art, e.g. U.S. Pat. Nos. 4,139,371; 4,169,725; and 4,415,356, all of which are incorporated herein by reference. Other continuous furnaces (converting or otherwise), e.g. the INCO oxygen flash converting furnace, the Noranda continuous converter, and the Mitsubishi converting furnace, can also be used in the practice of this invention. Noncontinuous or batch furnaces, e.g. Peirce-Smith converters, are not suitable for use in this invention.

Figure 2A:
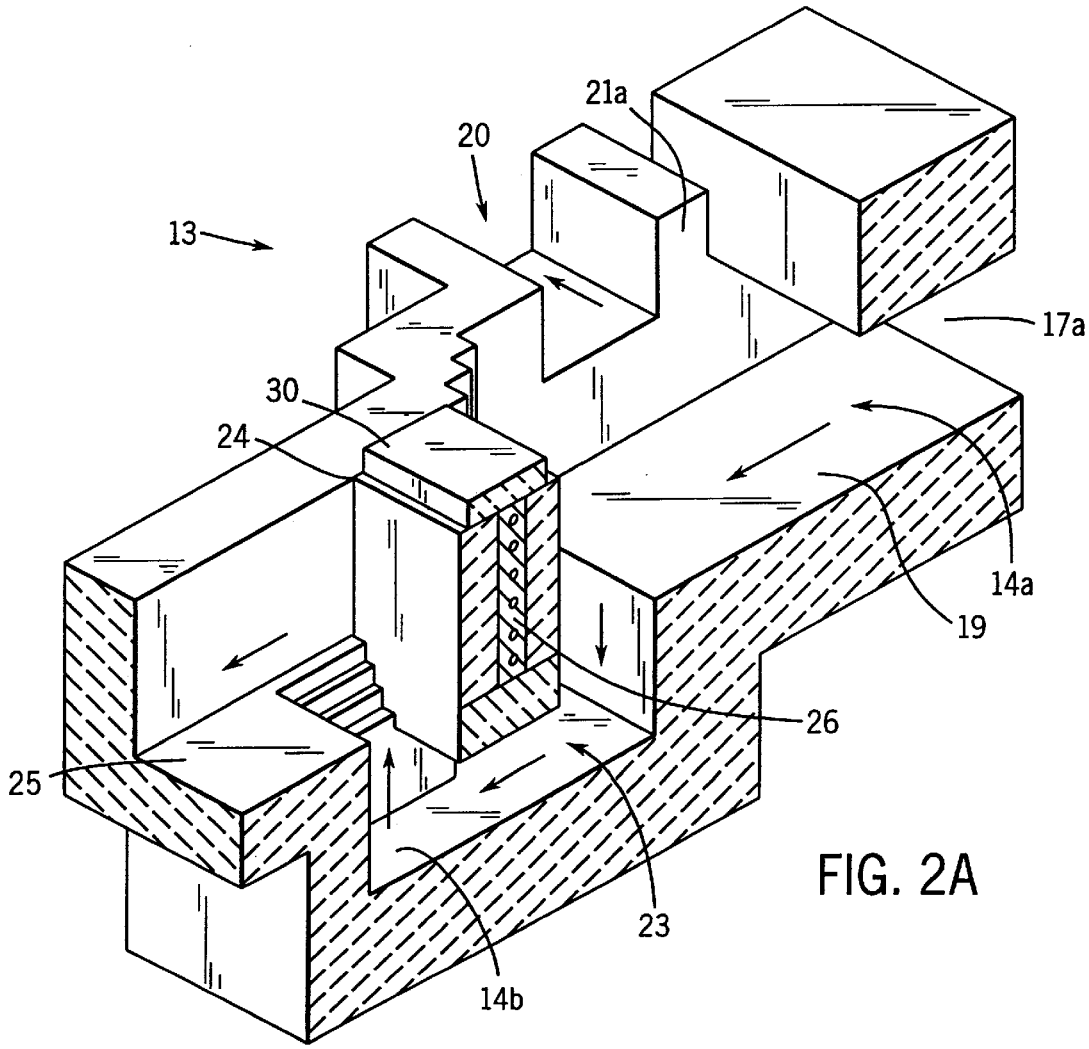
FIG. 2A is a top, cut-away perspective of the forebay of FIG. 1.
Figure 2B:
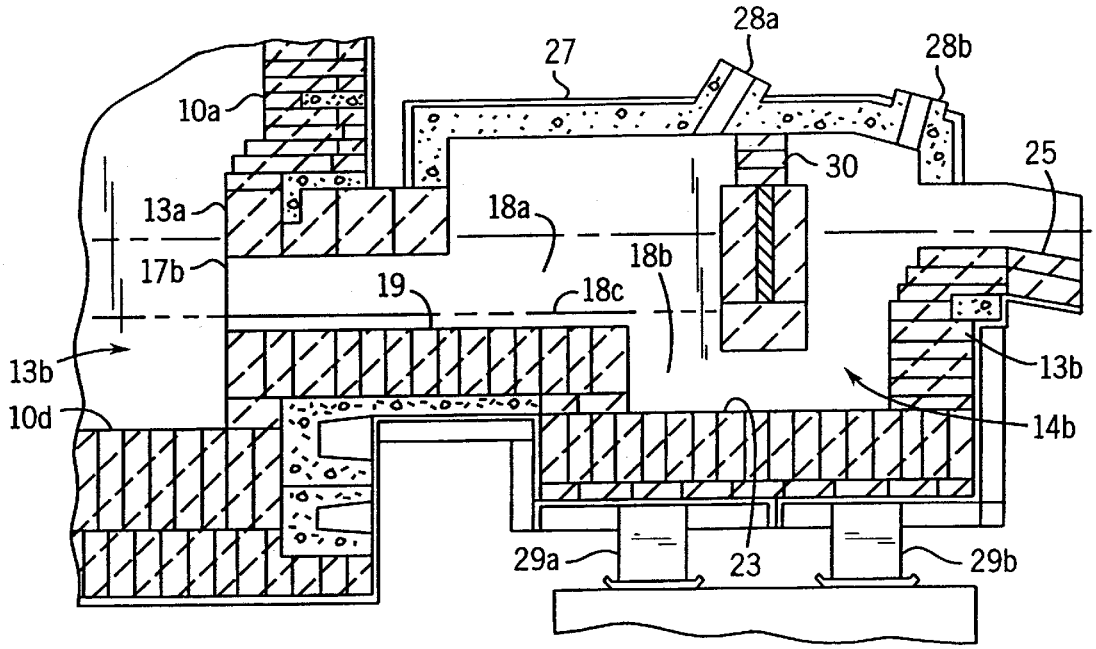
FIG. 2B is a side, cut-away cross-section of one embodiment of the furnace and forebay of FIG. 1.
Figure 2C:
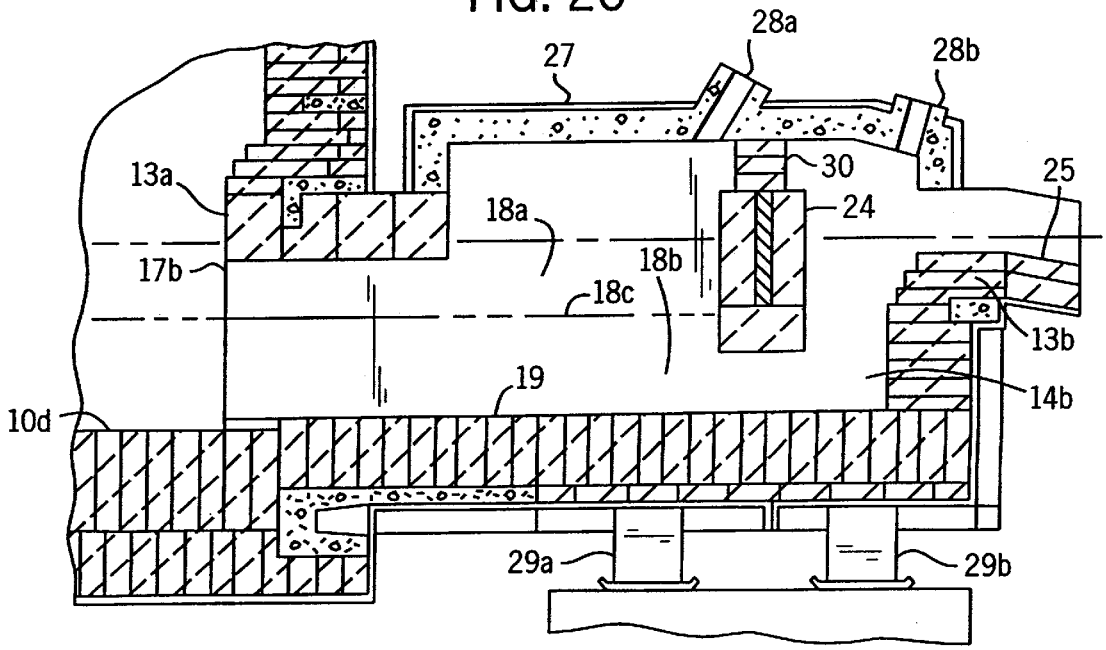
FIG. 2C is a side, cut-away cross-section of another embodiment of the furnace and forebay of FIG. 1.

Forebay 13 is attached in any convenient manner to the converting furnace, typically on the end wall farthest removed from the reaction shaft. The forebay comprises:

A. floor 19 (FIG. 2A);

B. first end wall 13*a* (FIGS. 2B–C) having entrance 17*a* (FIG. 2A) for receiving a two-phase melt, e.g. from converting furnace 10, the melt comprising slag phase 18*a* floating on top of and forming an interface 18*c* with metal product phase, e.g. blister copper, 18*b* (all shown in FIGS. 2B–D);

C. second end wall 13*b* (FIGS. 2B–C) opposite the first end wall, the second end wall having metal product overflow notch 25 (FIGS. 2A–C) for discharging the metal product from the forebay;

D. first and second sidewalls 21*a–b* (FIG. 4) joining the first and second end walls to one another, and at least one sidewall (here sidewall 21*a*) having slag overflow notch 20 (FIG. 2A) for discharging the slag phase from the forebay;

E. weir 24 having first and second faces 24*a* and 24*b*, first and second side edges 24*c* and 24*d* and top and bottom surfaces 24*e* and 24*f* (FIGS. 4 and 6), the first and second side edges in sealing contact with the sidewalls (i.e. the union or joint of the side edges and sidewalls is essentially impenetrable to both the slag and metal product) at a location between the slag overflow notch and the metal product overflow notch such that (i) the first face of the weir is opposite the entrance for receiving the melt and together with the forebay sidewalls, first end wall and floor forms slag skimming chamber (or zone) 14*a* (FIGS. 2A and 2D), (ii) the second face of the weir is opposite the metal product overflow notch and together with the forebay sidewalls, second end wall and floor forms riser chamber (or zone) 14*b* (FIGS. 2A and 2D), and (iii) the bottom surface of the weir and the forebay floor form underflow 23 (FIGS. 2A and 2D); and F. cover 27 (FIGS. 2B–D and 5) extending over the slag skimming and riser chambers.

Although typically a furnace requires only one forebay, a furnace may have more than one forebay and their locations on the furnace with respect to one another can vary to convenience. Multiple forebays can prove convenient in the context of achieving and maintaining maximum furnace operation time, e.g. when one forebay is out of operation for any reason, the other forebay(s) is(are) available to keep the furnace in operation. Multiple forebays may also be used to promote good metallurgical operation by preventing or reducing static layers (i.e. stagnant areas of slag or metal) from forming in parts of the furnace.

The forebay can form an integral part of the furnace, i.e. it can be built as an extension of the furnace, or it can be a separate unit, e.g. skid mounted but securely attached to a furnace wall in any conventional manner, e.g. bolted, mortared, etc. However integrated or attached, ideally the forebay and furnace provide a single closed environment (except, of course, for the product and byproduct discharge zones) for the slag and molten blister copper. The forebay comprises slag skimming chamber (also known as a slag skimming zone) 14*a* connected to slag launder 15 (or in certain embodiments, a spout), and riser zone 14*b* connected to a blister copper launder (or in certain embodiments, a spout) 16.

One embodiment of forebay 13 is illustrated in cut-away perspective in FIG. 2A. Entrance 17*a* to forebay 13 is in open communication with opening 17*b* (shown in FIGS.

2B–C) in end wall 10*a* of furnace 10 to which the forebay is attached. Opening 17*b* and entrance 17*a* are sized preferably such that both the blister copper and slag layers enter the forebay in the same manner in which they exist within furnace settler zone 10*b* (FIG. 2B), i.e. two relatively immiscible layers with the slag layer floating on top of the blister copper layer. Opening 17*b* is sized and located in furnace wall 10*a* at a height such that it is either completely submerged beneath the top surface of the slag layer within the furnace (shown in FIGS. 2B–C), or that a gas space exists between the top surface of the slag layer and the top surface of opening 17*b* (shown in FIG. 2D). In the first embodiment, the blister copper and slag form a gaseous seal between the environment of furnace freeboard zone 10*c* and the forebay environment. In the second embodiment, the gaseous environment of furnace freeboard zone 10*c* and the gaseous environment above the top surface of the slag within slag skimming zone 14*a* are in open communication with one another. The cross-sectional area and geometry of opening 17*b* and entrance 17*a* can be of any size and configuration, e.g. circular, oval, polygonal, etc. and can be the same as or different from one another, but are typically sized and configured to allow the blister copper and slag layers to enter the forebay in a relatively undisturbed state, e.g. without significant mixing of the respective layers. The blister copper and slag layers move naturally toward and through the furnace wall opening 17*b* and entrance 17*a* into the forebay as a result of the slag and metal product phases seeking levels in relation to their overflow heights in the forebay.

The forebay is constructed of any suitable material(s), but typically it consists of a metal shell lined with refractory appropriate to working with molten blister copper and slag. The particular dimensions of the forebay are scaled to the size, capacity and design of the converting furnace (including the number and location of forebays ultimately attached to the furnace). The forebay may be equipped with devices, e.g. cooling blocks, resistance heaters, etc., not shown and optional to its operation.

Figure 3B:
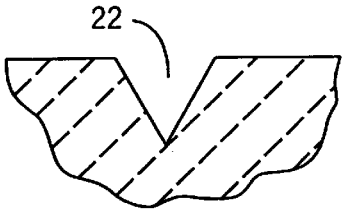
FIG. 3B is a side cross-section of a V-shaped overflow notch.
Figure 3C:
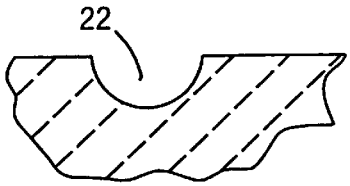
FIG. 3C is a side cross-section of a nonlinear-shaped overflow notch.

After the molten blister copper and slag enter the forebay through opening 17*b* and entrance 17*a*, these materials proceed into slag skimming chamber 14*a* with the bottom surface of the molten blister copper layer in contact with floor 19. Slag overflow notch 20 is located in slag skimming chamber side wall 21*a* at a height from floor 19 such that slag overflow notch 20 is above the slag/blister copper interface. The shape of the overflow notch can vary and in addition to the rectangular shape shown in the FIG. 2A, it includes a V-shape (FIG. 3B) and various nonlinear shapes, e.g. semicircular (FIG. 3C). In one embodiment of this invention (not shown), a slag overflow notch is located on side wall 21*b* (i.e. opposite the slag overflow notch shown in the Figures) while in another embodiment of the invention (also not shown), each separation chamber side wall has one or more slag overflow notches (of the same or different cross-sectional configuration). The size, i.e. the cross-sectional area, of the slag overflow notch can be enlarged or reduced during operation with the removal or addition of suitable materials to vary the height of the top surface of the slag phase in relation to the sidewall of the forebay.

Slag overflows from the slag skimming chamber 14*a* into and through overflow notch 20 into slag launder (or in certain embodiments, slag spout) 15. In one embodiment of this invention, the slag is collected in transportable vessels, e.g. ladle/crane assemblies, pots on rails, etc., while in another embodiment, the slag is immediately subjected to granulation by any convenient technique, e.g. water granulation, air granulation, rotating disk granulation, etc. The slag, in whatever form, is then recycled or otherwise processed for recovery of various metal values, or disposed in any safe and environmentally acceptable manner.

In one embodiment (shown in FIGS. 2A and 2B), the forebay is stepped, i.e. it is characterized by the bottoms of opening 17*b* and entrance 17*a* located sufficiently above settler floor 10*d* such that a significant part of the blister copper bath within the settler cannot move into the forebay. The stepped design does require for separate draining of the settler zone below the bottom surface of opening 17*b*, but it also provides for retention of some, if not most, of the blister copper bath in the event the forebay is disabled for whatever reason.

In another embodiment, the forebay is full-depth, i.e. it is characterized by the bottoms of opening 17*b* and entrance 17*a* corresponding to or at a near approximation to furnace floor 10*d* (i.e. the floor of settler zone 10*b*). As is evident from FIGS. 2B and 2C, the full depth forebay can be converted to a stepped forebay by the addition of refractory to floor 19.

With respect to underflow 23, in one embodiment it is in the form of a well or recess in floor 19 into which extends weir 24 (as illustrated in FIGS. 2A and 2B) while in another embodiment, it is simply an extension of floor 19 under weir 24 without a well or recess (as illustrated in FIG. 2C). In other embodiments (not shown), underflow 23 is a well in the floor of a full-depth forebay, e.g. the forebay illustrated in FIG. 2C but with a well below weir 24, or an extension of floor 19 in a stepped forebay, e.g. the forebay illustrated in FIG. 2B but without a well below weir 24 (and the bottom of weir 24, of course, sufficiently spaced above floor 19 to create a functional underflow). One advantage of the well configuration in both stepped and full-depth forebays is that the opportunities for slag to pass through to the riser zone are diminished.

Figure 4:
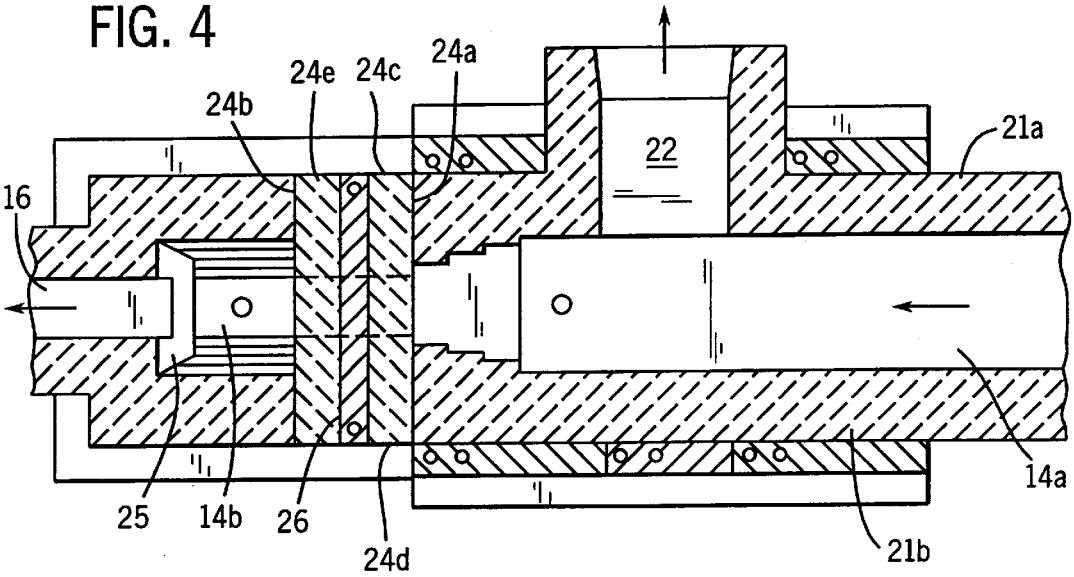
FIG. 4 is a top cross-section of the forebay of FIG. 3A along the line 4—4.
Figure 5:
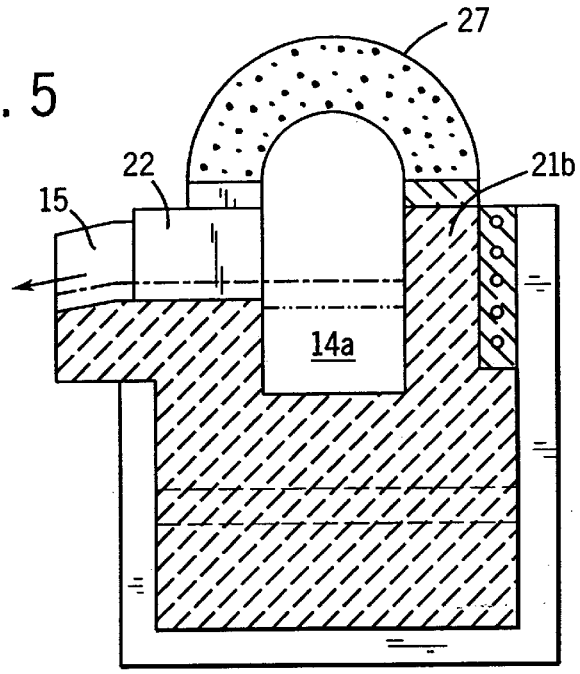
FIG. 5 is a cross-section of the forebay of FIG. 3A along the line 5—5.
Figure 6:
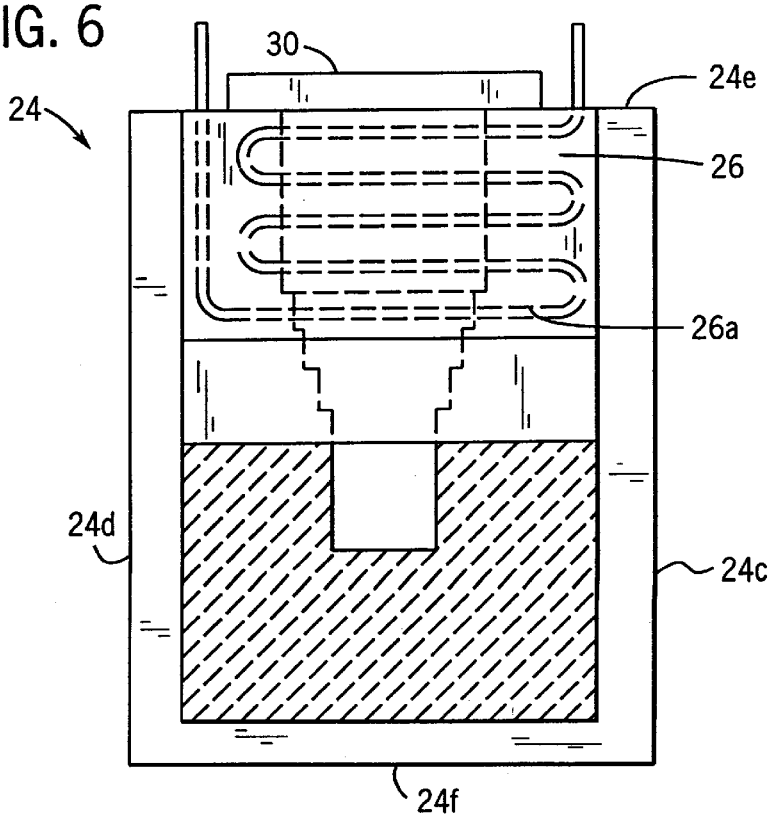
FIG. 6 is a cross-section of the forebay of FIG. 3A along the line 6—6.

Underflow 23 is of any convenient configuration, and FIGS. 2A, 4 and 6 show the cross-sectional shape of one such configuration. This shape shows a generally rectangular configuration on that side of weir 24 nearest the slag overflow notch, and a generally tapered configuration on that side of weir 24 furthest from the slag overflow notch (this side known as riser zone 14*b*). The taper is narrowest at the recessed floor and widest at blister copper overflow notch 25 (also referred to as a spout). The stepped taper shown in FIGS. 2A, 3, 4 and 6 is more a result of constructing the same from rectangular refractory bricks than for any other reason (although it is likely to provide better insulation than a nontapered riser zone due to the thicker brickwork) but like the cross-section of the slag overflow notch, this taper can also have a V- or nonlinear cross-sectional shape. In another embodiment (as shown in FIG. 2C), floor 19 does not form a recess or well under weir 24.

Referring again to FIG. 2A, weir 24 extends into underflow 23 in such a manner as to block the passage of slag from slag skimming chamber 14*a* to blister copper overflow notch 25, but not the passage of molten blister copper from slag skimming chamber 14*a* to blister copper overflow notch 25. The distance between the floor of the recess under the weir and the bottom surface of weir 24 can also vary, but it is typically less than the depth of the molten blister copper layer as it passes through entrance 17*a*. The size of weir 24 is scaled to the size of the forebay itself, and the general configuration of weir 24 can also vary widely. The rectangular shape depicted in FIG. 2A is typical, but a weir with rounded corners is also desirable from the perspective of reducing erosion of the refractory surface and in practice, the corners of the weir are likely to round over time due to erosion caused by the molten blister as it moves beneath it. Moreover, the width or thickness of the weir can also vary widely with such factors as ease of construction and maintenance of primary importance. Weir 24 contains cooling block 26 for purposes of extending refractory life. The lowest position (relative to top weir surface 24*e*) of bottom cooling passage 26*a* (FIG. 6) in cooling block 26 is preferably located above the level of the blister copper in the forebay (as illustrated in FIGS. 2B–C) so that if a water leak occurs, it does not leak into the blister copper (which could result in an explosion).

Due to the metallostatic pressure of the blister copper and slag within the furnace (which is analogous to hydrostatic pressure except that molten metal and slag is the liquid medium, not water), the blister copper will rise in riser zone 14*b* to a level intermediate between the top surface of the slag and the top surface of the blister copper within the slag skimming chamber. As such, metal product or blister copper overflow notch 25 is located at a height between the top surface of the slag and the top surface of the metal product in the slag skimming zone to ensure that the blister copper continuously drains from the forebay (as illustrated in FIGS. 2B–D). The blister copper overflows from metal product overflow notch 25 into launder 16 for routing to another vessel, e.g. an anode or holding furnace.

During periods in which the molten phases are not flowing through the forebay, the static phases in the forebay (including those in the underflow and riser zone) are maintained in a molten state by a heating system of any convenient design. Alternatively, if the forebay is "cold" for any reason, e.g., shutdown of the furnace for routine maintenance, the heating system can preheat the forebay (including melting any solidified slag and/or blister copper remaining in the forebay from a previous operation) before placing it back in operation. In one embodiment, slag resistance heating is used, while in another embodiment one or more oxygen-fuel or plasma torches are employed. In yet another embodiment, an induction heater is used. In preferred embodiments, plasma heating of the top surface of the melt is employed alone or in combination with induction heating of the riser zone. The flow of molten material through the forebay is easily stopped by damming the overflow notch and blister copper overflow notch with refractory or clay.

The forebay is closed with cover 27 (FIGS. 2B–C and 5) which ideally forms a gas tight seal with the side walls of the forebay (with the understanding that openings exist for the discharge of slag and blister copper). Optionally, cover 27 is equipped with burners 28*a* and 28*b* to maintain the blister copper in a molten state. The burners can be of any conventional design, and are preferably located downstream from the slag overflow notch(es). If burners are employed in the cover, then the gases generated by them and the molten slag and/or blister copper must have a vent for their removal from the forebay. In those forebay designs in which a continuous gas space exists over the slag skimming chamber into the furnace, the gases in the forebay are naturally vented into the furnace freeboard zone due to the draft created by offtake shaft 12. In those forebay designs in which such a continuous gas space does not exist, then the forebay must be equipped with a vent port (not shown). Gases generated in the gas space above the blister copper in the riser zone are vented through the blister copper overflow notch.

To provide a more complete separation between slag skimming chamber 14*a* and riser zone 14*b*, divider 30 (typically constructed of refractory and illustrated in FIGS. 2A–D) is built between top weir surface 24*e* and the inside surface of cover 27. Not only does this divider serve to provide distinct zones within the forebay, but it also forms a seal with respect to the gases above the slag and blister copper in slag skimming zone 14*a* and riser zone 14*b*, respectively.

To protect it against damage due to the natural movement of the furnace during operation, the forebay is optionally mounted on skid supports 29*a* and 29*b* (FIGS. 2B and 2C) and equipped with springs or similar devices (neither shown) to provide tensioning between it and the furnace. The forebay is also equipped with cooling blocks and other devices to prolong the life of its refractory and the placement of these structures can and will vary with the design of the forebay.

The phase levels within the forebay, and therefore within the furnace settler, are controlled by well known barometric relationships. Thus the barometric head of blister copper in the riser zone of the forebay balances the combined barometric heads of blister copper and slag in the slag skimming chamber. The level of blister copper in the furnace settler is preferably controlled by the height of the blister copper overflow notch relative to the forebay floor. This lip is always higher than the lowest point of the opening to/entrance of the forebay (e.g. the bottoms of opening 17*b* and/or entrance 17*a*). In addition to controlling the phase levels, this protects the settler refractory near and about the end wall opening to the forebay because blister copper, unlike slag, has a low corrosivity to refractory brick.

The level of blister copper above the bottom of the opening to/entrance of the forebay can be raised by raising the height of the blister copper overflow notch. The level of slag above the blister copper layer can be raised by raising the height of the slag overflow notch. Accordingly, the levels of the phases in both the forebay and the furnace settler can be controlled independently of one another for optimum metallurgical efficiency.

With respect to the slag layer, good metallurgical practice requires monitoring, by any conventional means, the size, i.e. depth, of this layer. If the slag layer becomes too deep, then it can push slag beneath the weir such that it under flows the weir and enters the riser zone from which it ultimately overflows into the blister copper launder or spout. Another ill effect from a slag layer of too much depth is the possibility of slag foaming which can interfere with efficient phase separation and furnace operation. The forebay provides a convenient and effective method for maintaining a proper slag layer depth. The optimum depth of the slag layer will vary with a number of furnace design and operating factors.

In operation, molten slag and blister copper enter, due to the influence of gravity, the forebay from the converting furnace through opening 17*b* and entrance 17*a* in essentially the same arrangement in which they exist within the settler of the furnace, i.e. molten slag floating upon molten blister copper. If the molten slag and blister copper enter the forebay in a manner as illustrated in FIG. 2B, i.e. the top surface of the slag layer is above the top of the entrance to the forebay, then the forebay is "flooded". In this circumstance, a gas space in open communication with both the furnace and the forebay is not created, and a positive or negative pressure may be created within the furnace. If the molten slag and blister copper enter the forebay in a manner as illustrated in FIG. 2D, i.e. the top surface of the slag layer is below the top of the entrance to the forebay, then the forebay is not flooded. In this circumstance, a gas space in open communication with both the furnace and the forebay is created, and the pressure in the furnace and the forebay is essentially the same. In certain circumstances, operation of the furnace at a negative pressure relative to the forebay (or the surrounding environment, for that matter) is desirable because it results in certain operating efficiencies relative to energy usage, product yield, etc.

The phase interface is relatively well-defined. As this two phase mixture moves into the slag skimming chamber, the molten slag layer is continuously removed due to the influence of gravity through the slag overflow notch. The weir blocks the forward progress of the slag layer, and thus the only exit from the forebay for this layer is through the slag overflow notch.

Since the weir does not extend to the slag skimming chamber floor, an underflow, i.e. gap or space, exists under the weir for the blister copper to move forward to the riser zone. However, since the weir does block the forward movement of the slag, only blister copper pools in the riser zone. Due to the metallostatic pressure of the molten blister copper and slag within the furnace, the blister copper will rise to a level intermediate between the top surface of the slag and the top surface of the blister copper in the slag skimming chamber and since this level is above the riser lip, i.e the blister copper overflow notch, the blister copper overflows the lip into the blister copper launder or spout.

While the blister copper and slag are within the forebay, preferably they are subjected to further oxidation for removal of residual sulfur and to maintain each in a highly fluid molten state. The forebay is sized such that blister copper and slag are continuously removed at the rate at which they are formed within the furnace. If oxidation of the blister copper is to continue within the forebay, then the size of the forebay is such that it can also accommodate the equipment (e.g. lances, porous plugs, etc.) and residence time necessary to effect this oxidation. This may result in a forebay with physical dimensions larger than that required simply to drain and separate the melt as received from the furnace.

The amount or height of the two phase blister copper/slag mixture is monitored by any convenient means (e.g. laser or optical level measurement devices) such that the top surface of the molten blister copper in the slag skimming zone does not rise above the bottom surface of the slag overflow notch (such that blister copper is discharged through the slag launder), or that the bottom surface of the molten slag drops beneath the bottom surface of the weir (such that slag enters the riser zone). The position of the slag and metal product interface can be calculated from knowledge of the slag and metal product top surfaces. In moments of upset, the forebay can be modified or closed by plugging the opening to the furnace and/or the various overflow notches. These notches can be constricted or closed in any effective manner, e.g., by the addition (mortaring, clamping, etc.) of refractory bricks (or a refractory shape preconfigured to the notch), or a chilled copper wedge, etc. Such techniques, of course, increase the holding capacity of the furnace itself.

When the furnace is shut down, the slag and metal levels will fall until their levels are at the bottom edge of their respective weirs. Levels can be further reduced by removing any devices that were inserted into the weirs (e.g., bricks, refractory shapes, chilled copper wedges, etc.) to increase levels (hence holding capacities) during normal operation.

Although the invention has been described in considerable detail through the preceding embodiments, this detail is for the purpose of illustration. Many variations and modifications can be made without departing from the spirit and scope of the invention as described in the appended claims.

What is claimed is:

1. A furnace for the continuous conversion of copper matte to anode copper, the furnace comprising (i) a settler with a floor, and (ii) a forebay, the forebay comprising:

A. a floor;

B. a first end wall having an entrance for continuously receiving a two-phase melt from the settler, the melt comprising a slag phase floating on top of a metal product phase;

C. a second end wall opposite the first end wall, the second end wall having a metal product overflow notch for continuously discharging the metal product phase from the forebay;

D. first and second sidewalls joining the first and second end walls to one another, and at least one sidewall having a slag overflow notch for continuously discharging the slag phase from the forebay;

E. a weir having first and second faces, first and second side edges and top and bottom surfaces, the first and second side edges in sealing contact with the sidewalls at a location between the slag overflow notch and the metal product overflow notch such that (i) the first face of the weir is opposite the entrance for receiving the melt and together with the forebay sidewalls, first end wall and floor forms a slag skimming chamber, (ii) the second face of the weir is opposite the metal product overflow notch and together with the forebay sidewalls, second end wall and floor forms a riser chamber, and (iii) the bottom surface of the weir and the forebay floor form an underflow; and F. a cover extending over the slag skimming and riser chambers, the cover equipped with a burner.

2. The forebay of claim 1 in which the floor forms a well beneath the bottom surface of the weir.

3. The forebay of claim 1 in which the slag overflow notch has a V-shaped cross-section.

4. The forebay of claim 1 in which the slag overflow notch has a rectangular-shaped cross-section.

5. The forebay of claim 1 in which the weir contains a cooling block.

6. The forebay of claim 1 further comprising a divider between the top surface of the weir and the cover.

7. The forebay of claim 1 in which at least one burner is located above the slag skimming chamber and at least one burner is located above the riser chamber.

8. The forebay of claim 1 in which the burner is a plasma burner.

9. The forebay of claim 8 in which the riser chamber is equipped with an induction heater.

10. The forebay of claim 1 mounted upon a skid.

11. The forebay of claim 1 in which the floor of the forebay is above the settler floor.

12. The forebay of claim 1 in which the floor of the forebay is at approximately the same height as that of the settler floor.

13. The forebay of claim 1 in which the entrance of the forebay has a slot-shaped cross-section.

* * * * *